United States Patent [19]

Uematsu et al.

[11] Patent Number: 4,612,127

[45] Date of Patent: Sep. 16, 1986

[54] LUBRICANT FOR METAL FORMING AND PROCESS FOR METAL FORMING

[75] Inventors: Takao Uematsu, Hitachi; Shigeki Komatsuzaki, Mito; Tomoe Takamura; Fumio Nakano, both of Hitachi; Toshikazu Narahara, Ibaraki, all of Japan

[73] Assignee: Hitachi, Ltd., Tokyo, Japan

[21] Appl. No.: 654,686

[22] Filed: Sep. 26, 1984

[30] Foreign Application Priority Data

Sep. 28, 1983 [JP] Japan ..... 58-179752
Dec. 16, 1983 [JP] Japan ..... 58-238517

[51] Int. Cl.[4] ..... C10M 137/06

[52] U.S. Cl. ..... 252/32.5; 252/25; 252/49.8; 72/42

[58] Field of Search ..... 252/32.5, 49.8, 25, 252/18; 72/42

[56] References Cited

U.S. PATENT DOCUMENTS 4,268,404 5/1981 Ahlgrem et al. ..... 252/25
4,305,831 12/1981 Johnson ..... 252/25

*Primary Examiner*—Jacqueline V. Howard
*Attorney, Agent, or Firm*—Antonelli, Terry & Wands

[57] ABSTRACT

A substantially water-free, liquid lubricant for metal forming, which comprises a lubricating oil, and at least one of linearly condensed phosphorus compounds represented by the following general formula (1):

$$M_mH_{n+2-m}P_nO_{3n+1} \quad (1)$$

wherein m is an integer of 0, 1, . . . , n+1, n is an integer of 2 to 6, and M is an alkali metal, and cyclically condensed phosphorus compounds represented by the following general formulae (2) and (3):

$$(HPO_3)_n \quad (2)$$

$$M_xH_y(PO_3)_{x+y} \quad (3)$$

wherein n is an integer of 2 to 8, M is an alkali metal, and each of x and y is an integer of 1 or more, where $x+y \leqq 8$, and furthermore at least one of organic compounds having phosphorus, sulfur or chlorine as an extreme-pressure agent, and furthermore a fatty acid can form a lubricating film with a good heat resistance and a good lubricating ability by heat generated during metal forming only by applying it to the surface of a workpiece or a mold and can work effectively for preventing the workpiece from galling, greatly contributing to simplification of the production steps and reduction in product cost.

18 Claims, 4 Drawing Figures

LUBRICANT FOR METAL FORMING AND PROCESS FOR METAL FORMING

BACKGROUND OF THE INVENTION

This invention relates to a lubricant for metal forming, which can form a lubricating film on a metal surface by virture of the heat generated by deformation or friction during the metal forming such as cold forming i.e. forming without heating of a metallic workpiece, etc., and also to a process for metal forming with said lubricant.

A lubricant for metal forming must have a satisfactory lubricating ability up to an elevated temperature caused by deformation, friction, etc. and also to increasing new surface area of a workpiece created by the metal formation. The lubricants so far proposed for this purpose are water-soluble or water-insoluble liquid lubricants containing mineral oil or synthetic oil or their mixture as the major component and further containing a semi-solid lubricant such as metal soap, beef tallow, etc., a sulfur-based, chlorine-based, or phosphorus-based extreme pressure agent, or a solid lubricant such as graphite, molybdenum disulfide, etc. These lubricants can be used, without any problem, for the metal forming with low reduction of area, but in the case of high reduction of area which produces a higher temperature or a higher surface pressure, or in the case of forming products of complicated shapes, their load-carrying capacity, heat resistance, etc. are not satisfactory, resulting in galling. For the lubrication for larger plastic deformation, or forming products of complicated shapes, it has been so far proposed to plate a workpiece surface with a soft metal, such as copper, zinc, etc., or to coat a workpiece surface with a plastic resin film, or to conduct phosphate coating or oxalate coating of a workpiece surface. These lubricating coating treatments require a sufficient pretreatment and complicated coating steps, and thus require much labor and large costs and also have further problems of removing the coatings after the forming or of environmental pollution by the waste liquor from the coating treatments or removal of the coatings after the forming.

Recently, lubricants containing phosphoric acid or its salts, boric acid or its salts, carbonates, nitrates, sulfates, or hydroxides of alkali metal, and laminar silicate, etc. have been proposed (Japanese Patent Application Kokai (Laid-open) No. 57-73089). However, since they consist of water-soluble glass powder of $P_2O_5$, $B_2O_2$ and $M_2O$ (where M represents an alkali metal), and the laminar silicate, or their mixture and water, they fail to show lubrication at a low temperature forming such as cold forming, and thus cannot be used as lubricants for cold forming.

Furthermore, an acidic lubricant for cold forming, which is prepared by reaction of a multivalent metal cation, orthophosphate, and alkyl alcohol or alkylaryl alcohol having 10 to 36 carbon atoms, and which has a water content of not more than 20% by weight has been proposed (Japanese Patent Publication Kokai (Laid-open) No. 47-15569), and lubricants further containing mineral oil, carboxylic acid, and alkylamine besides the said acidic lubricant, for example, lubricants for cold forming, which comprises 30 to 95% by weight of an organic lubricant such as mineral oil, oleic acid, or oleylamine, 5 to 60% by weight of a reaction product of a multivalent metal cation, polyphosphoric acid and an alcohol having 10 to 36 carbon atoms in a ratio of the metal cation:$P_2O_5$:the alcohol=1:3-60:14-150 by weight, and 0.5 to 10% by weight of water have been proposed (U.S. Pat. No. 3,932,287). These lubricants show good results in drawing of pipes, etc., but fail to meet the requirements for forming steel workpieces with high reduction of area.

SUMMARY OF THE INVENTION

An object of the present invention is to provide a substantially water-free, liquid lubricant for metal forming, which can have an excellent lubricating ability even under high reductions of area that produce a higher temperature and a higher pressure at the sliding interface between a tool and a workpiece.

Another object of the present invention is to provide a process for metal forming in a very simple manner in forming a lubricating film, using a substantially water-free, liquid lubricant for metal forming, which can keep an excellent lubricating ability even under high reductions of area that produces a higher temperature and a higher pressure.

According to a first aspect of the present invention a lubricating film having a good heat resistance and a good lubricating ability is formed on the surface of a metallic workpiece by virtue of the heat generated by deformation, or friction during the metal forming only by wetting the surface of a metallic workpiece such as a steel workpiece, or the surface of a mold with a substantially water-free, liquid lubricant for metal forming, which comprises a lubricating oil and at least one of the linearly condensed phosphorus compounds represented by the following general formula (1):

$$M_mH_{n+2-m}P_nO_{3n+1} \quad (1)$$

wherein m is an integer of 0, 1, . . . , n−1, n is an integer of 2 to 6, preferably 2 to 5, and the M is an alkali metal, and cyclically condensed phosphorus compounds represented by the following general formulae (2) and (3):

$$(HPO_3)_n \quad (2)$$

$$M_xH_y(PO_3)_{x+y} \quad (3)$$

wherein n is an integer of 2 to 8, preferably 2 to 4, M is an alkali metal and each of x and y is an integer of 1 or more, where $(x+y \leqq 8)$.

According to a second aspect of the present invention, a lubricating film having a good heat resistance, a good lubricating ability and higher formability is formed on the surface of a metallic workpiece by virtue of the heat generated by deformation or friction during the metal forming only by wetting the surface of a metallic workpiece or the surface of a mold with a substantially water-free, liquid lubricant for metal forming, which comprises a lubricating oil, at least one of said condensed phosphorus compounds represented by said general formulae (1) to (3), and at least one of the organic compounds containing phosphorus, sulfur or chlorine as an extrame pressure agent.

According to a third aspect of the present invention, formation of a lubricating film with a good heat resistance and a good lubricating ability is further promoted by using a substantially water-free, liquid lubricant of said first or second aspect, which further contains saturated fatty acid or unsaturated fatty acid.

The lubricating oil for use as a base oil in the present invention is the ordinary, commercially available lubricating oil, including, for example, mineral oil, synthetic oil such as ester oil, polyether oil, silicone oil and fluorinated oil, and their mixtures.

The condensed phosphorus compound for use in the present invention includes metaphosphoric acid, polyphosphoric acid, pyrophosphoric acid, acid salt of metaphosphoric acid, acid salt of polyphosphoric acid and acid salt of pyrophosphoric acid. The acid salt of pyrophosphoric acid includes sodium hydrogen pyrophosphate and potassium hydrogen pyrophosphate; the acid salt of polyphosphoric acid includes sodium hydrogen polyphosphate and potassium hydrogen polyphosphate; the acid salt of metaphosphoric acid includes sodium hydrogen metaphosphate, etc.

At least one of these condensed phosphorus compounds is added to the lubricating oil, and these condensed phosphorus compounds as one component for the present lubricant for metal forming are an essential factor for forming a lubricating film on the surface of a metallic workpiece during the metal forming and their mixing ratio, on which the amount of a lubricating film as formed depends, can be adjusted appropriately in view of the metal forming conditions. The lubricating oil containing the condensed phosphorus compound improves the lubricating ability of coating of condensed phosphorus compound formed as a film on the surface of a metallic workpiece or a mold by virtue of the heat generated by deformation or friction during the metal forming, and shows distinguished extreme pressure effect and lubricating effect in a wide temperature range.

The organic compounds containing phosphorus for use as the extreme pressure agent in the present invention are phosphite esters and phosphate esters. The phosphite esters include, for example, triphenyl phosphite, tricresyl phosphite, diphenylnonylphenyl phosphite, tris (nonylphenyl) phosphite, triisooctyl phosphite, diphenylisodecyl phosphite, phenyldiisodecyl phosphite, triisodecyl phosphite, trilauryl phosphite, trioctadecyl phosphite. trioleyl phosphite, trilauryl trithiophosphite, diisodecyl hydrogen phosphite, dilauryl hydrogen phosphite, dioleyl hydrogen phosphite, tris-chloroethyl phosphite, tris-tridecyl phosphite, dibutyl hydrogen phosphite, etc. The phosphate esters include, for example, trimethyl phosphate, triethyl phosphate, tributyl phosphate, tributoxyethyl phosphate, triphenyl phosphate, tricresyl phosphate, trixylenyl phosphate, cresyldiphenyl phosphate, octyldiphenyl phosphate, xylenyldiphenyl phosphate, trilauryl phosphate, tricetyl phosphate, tristearyl phosphate, trioleyl phosphate, dibutyl phosphate, monobutyl phosphate, dioctyl phosphate, monoisodecyl phosphate, tris-chloroethyl phosphate, tris-dichloropropyl phosphate, methyl hydrogen phosphate, isopropyl hydrogen phosphate, butyl hydrogen phosphate, octyl hydrogen phosphate, isodecyl hydrogen phosphate, lauryl hydrogen phosphate, tridecanoyl hydrogen phosphate, octadecyl hydrogen phosphate, oleyl hydrogen phosphate, etc.

The organic compounds containing sulfur for use as the extreme pressure agent in the present invention include, for example, sulfurized oil, sulfurized dipentene, sulfurized isobutene, sulfurized olefin, dibenzyl disulfide, polysulfide, xanthic disulfide, di-t-butyl sulfide, diphenyl disulfide, di-n-butyl sulfide, di-t-nonyl polysulfide, di-n-octyl disulfide, polyoxyethylene polysulfide, etc.

The organic compounds containing chlorine for use as the extreme pressure agent in the present invention include, for example, chlorinated paraffin, chlorinated oil, chlorinated fatty acid ester, pentachlorofatty acid ester, etc.

When at least one of these condensed compounds or further together with at least one of these organic compounds containing phosphorus, sulfur or chlorine as the extreme pressure agent is added to the lubricating oil, and when the lubricating oil is mineral oil, or synthetic oil such as ester oil, polyether oil, silicone oil, fluorinated oil, etc. or their mixture, an emulsifying agent can be added thereto to make the mixture into a uniformly suspended dispersion. The emulsifying agent can be selected as desired particularly in view of the species of lubricating oil and the condensed phosphorus compounds. The lubricating oil for use in the present invention includes, for example, polymeric succinic acid esters, polymethacrylates or polymethacrylic acid esters, ethylene-α-olefin copolymers, styrene-isobutylene copolymers, polyisobutylene, etc. which can be used alone or in mixture.

When the lubricating oil is a water-soluble lubricating oil, such as polyethyleneglycol, polypropyleneglycol, polyoxyethyleneglycol monoether, polyoxypropyleneglycol monoether, etc., it is not necessary to add such an emulsifying agent thereto. Thus, the lubricating oil for use in the present invention should be selected in view of conditions for metal forming, reduction of area, metal forming temperature, etc.

The lubricating oil containing at least one of the condensed phosphor compounds or together with at least one of organic compounds containing phosphorus, sulfur or chlorine as the extreme pressure agent can form a lubricating film of the condensed phosphorus compound and the organic compound containing phosphorus, sulfur or chlorine and having a distinguished extreme pressure effect and a distinguished lubricating effect in a wide temperature range on the surface of a metallic workpiece by virtue of the heat generated by deformation or friction during the metal forming.

When fatty acid is added to a lubricating oil containing the condensed phosphorus compound in the present invention, formation of a film of condensed phosphorus compound is promoted, and the lubricating ability is increased. Particularly when fatty acid is added to a lubricating oil containing the condensed phosphorus compound and the organic compound containing phosphorus, sulfur or chlorine as the extreme pressure agent in the present invention, the resulting film of the condensed phosphorus compound and the organic compound containing phosphorus, sulfur or chlorine as the extreme pressure agent has distinguished formabilities such as more improved extreme pressure effect, heat resistance and lubricating ability.

The fatty acid for use in the present invention includes saturated fatty acids such as butanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, etc., and unsaturated fatty acids such as 2,4-hexadienoic acid, trans-2-cis-4-decadienoic acid, 6, 10, 14-hexadecatrienoic acid, cis-9-cis-12-octadecadienoic acid, cis-9-cis-12-cis-15-octadecatrienoic acid, oleic acid, etc., and dimer acids obtained by dimerization of unsaturated fatty acid by heating or by a catalyst.

In the case of higher temperature, for example, when a mold temperature exceeds about 300° C. during the metal forming, a solid lubricant such as graphite, molybdenum disulfide, boron nitride, Teflon, fluorocarbon, etc. can be added to the said liquid lubricants according to the present invention.

It is practically desirable that the liquid lubricant according to the first aspect of the present invention can contain 2 to 20 parts by weight of the condensed phosphorus compound per 100 parts by weight of the lubricating oil. Below 2 parts by weight of the condensed phosphorus compound, formation of the lubricating film will be deteriorated, and the formability will be lowered, whereas, above 20 parts by weight of the condensed phosphorus compound, no better formability will be often obtained, and such excessive addition is not economically preferable.

When fatty acid is further contained in said liquid lubricant according to the first aspect of the present invention, it is desirable that 2 to 20 parts by weight of the condensed phosphorus compound and 1 to 33 parts by weight of the fatty acid are contained per 100 parts by weight of the lubricating oil. Below 2 parts by weight of the condensed phosphorus compound, or below 1 part by weight of the fatty acid, no satisfactory lubricating film will be formed, and thus galling will often develop. Above 20 parts by weight of the condensed phosphorus compound or above 33 parts by weight of the fatty acid, no better effect will be obtained, and such excessive addition is not economically preferable.

It is practically desirable that the liquid lubricant according to the second aspect of the present invention can contain 1 to 10 parts by weight of the condensed phosphorus compound and 5 to 30 parts by weight of the organic compound containing phosphorus, sulfur or chlorine as the extreme pressure agent per 100 parts by weight of the lubricating oil.

When the fatty acid is further contained in said liquid lubricant according to the second aspect of the present invention, it is desirable that 1 to 10 parts by weight of the condensed phosphorus compound, 1 to 30 parts by weight of the organic compound containing phosphorus, sulfur or chlorine as the extreme pressure agent, and 6 to 20 parts by weight of the fatty acid are contained per 100 parts by weight of the lubricating oil.

When the amounts of said various additives to the lubricating oil are less than the respective lower limits, formation of a lubricating film on the surface of a metallic workpiece or a mold will be deteriorated, and galling will often develop, depending on the forming conditions. When the amounts of the additives are more than the respective upper limits on the other hand, the formability will be no more improved, and such excessive addition is not economically preferable.

When an emulsifying agent is further contained in the present liquid lubricants, it is desirable that 0.1 to 5 parts by weight of the emulsifying agent is contained per 100 parts by weight of the lubricating oil. Below 0.1 parts by weight of the emulsifying agent, no satisfactory emulsifying effect will be obtained, whereas above 5 parts by weight of it no better emulsifying effect will be obtained, and such excessive addition is not economically preferable.

Most preferable composition of the present liquid lubricant comprises 100 parts by weight of mineral oil (viscosity at 40° C.: 50 to 200 $mm^2/s$), 3 to 8 parts by weight of linear polyphosphoric acid as the condensed phosphorus compound, 9 to 24 parts by weight of an acid ester of phosphorus acid such as dioleyl hydrogen phosphite as the organic compound containing phosphorus, sulfur, or chlorine as the extreme pressure agent, and 0.5 to 2 parts by weight of a polymeric succinic acid ester as the emulsifying agent.

The object of the present invention can be attained only by wetting the surface of a metallic workpiece or a mold for metal forming with the present liquid lubricant according to the well known method, for example, by spraying, brushing, roll coating, etc., followed by metal forming, or can be also attained by heating either the present liquid lubricant or the metallic workpiece and dipping the metallic workpiece into the lubricant, thereby forming a lubricating film on the surface of metallic workpiece, followed by metal forming. Thus, the present invention requires no such complicated steps as in the conventional coating treatment, and thus can be very simple in the process.

DESCRIPTION OF THE PREFERRED EMBODIMENTS

The effects of the present liquid lubricant for metal forming will be described in detail below, referring to Examples, which will not be limitative to the present invention.

EXAMPLES 1 TO 10

Figure 1:
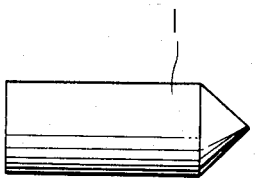
FIG. 1 is a side view showing the typical shape of a metallic workpiece for metal forming used in Examples.

The present liquid lubricants having compositions shown in Table 1, where mineral oil (FBK 150, trademark of a product made by Nippon Oil Company, Ltd., Japan) was used as a base oil, were applied to the surfaces of workpieces 1, as shown in FIG. 1, chromium-molybdenum steel columns with a nose, 9.9 mm in diameter, 30 mm long and 90° at nose angle [SCM 415 as described in JIS (Japanese Industrial Standard G 4105: C: 0.13–0.18 wt.%, Si: 0.15–0.35 wt.%, Mn: 0.60–0.85 wt.%, P: under 0.030 wt.%, S: under 0.030 wt.%, Cr: 0.90–1.20 wt.%, Mo: 0.15–0.30 wt.%, the balance being Fe)].

Figure 2:
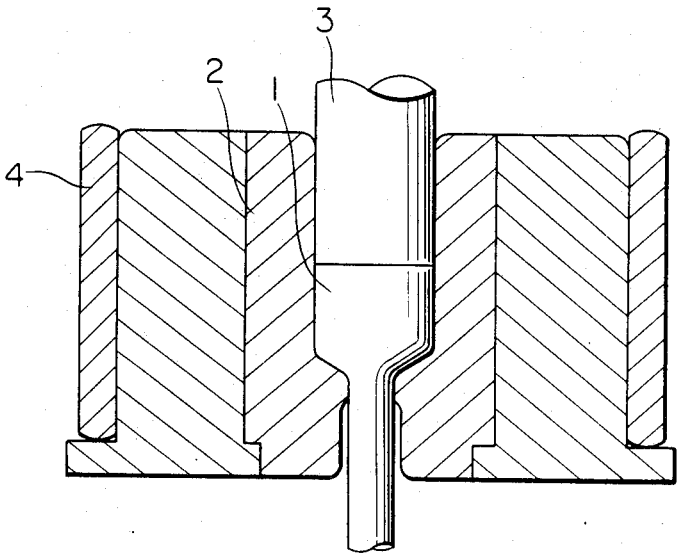
FIG. 2 is a cross-sectional view of an apparatus for metal forming of the workpiece of FIG. 1 with the present lubricants and the comparative conventional lubricants.

Then, the workpieces 1 were subjected to metal forming by forward extrusion with an ultra-hard mold 2 with an extrusion angle of 120° and a draw diameter of 6 mm (reduction of area: 64%) and a punch 3, as shown in FIG. 2 to evaluate the formability. The results of evaluation are shown in Table 2.

The formability was evaluated as follows. A band heater 4 was provided around the mold 2 to elevate the mold temperature from the room temperature stagewise, for example, by 5° to 10° C. for each stage, and 20 workpieces 1 of each Example, to which the present liquid lubricants were applied, were subjected to metal forming, and maximum mold temperatures up to which no galling developed on the surfaces of workpieces after the metal forming were measured.

A higher maximum mold temperature has a better formability of the lubricant.

The conventional lubricants used for comparison with the present liquid lubricants are as follows:

COMPARATIVE EXAMPLE 1

Commercially available oil for metal forming having the following composition (Sarakuratto X500, trademark of a product made by Kyodo Yushi Co., Ltd., Japan) was used:

additive:

fatty oil content: 43% by weight chlorine content: 12% by weight sulfur content: 6% by weight Base oil:

mineral oil: balance

COMPARATIVE EXAMPLE 2

The same workpieces used in Examples 1 to 10 were treated according to the well known phosphate coating consisting of the following steps: defatting→cold water washing→acid pickling→hot water washing→phosphate treatment→water washing→neutralization→lubricating treatment→drying.

Formabilities of the workpieces of Comparative Examples 1 and 2 were evaluated in the same manner as in Examples 1 to 10. The results of evaluation are shown in Table 2.

As is evident from Table 2, the present liquid lubricants of Examples 1 to 10 have considerably improved formabilities, and the formabilities substantially equal to that of the conventional phosphate coating of Comparative Example 2 requiring complicated coating steps can be obtained only by applying the present lubricants to the surfaces of workpieces.

EXAMPLES 11 TO 18

Formabilities of the present liquid lubricants having the compositions shown in Table 3, where polyol ester oil (Unistar H 381, trademark of a product make by Nihon Yushi Co., Ltd., Japan) was used as a based oil, were evaluated in the same manner with the same workpieces and mold as in Example 1. The results of evaluation are shown in Table 4.

As is evident from Table 4, the present liquid lubricants for metal forming have good formabilities, as compared with that of Comparative Example 1 shown in Example 1.

EXAMPLES 19–28

Formabilities of the present liquid lubricants having the compositions shown in Table 5, where water-soluble lubricating oil, polyalkyleneglycol (Unilube MB-14X, trademark of a product made by Nihon Yushi Co., Ltd., Japan) was used as a base oil), were evaluated in the same manner with the same workpieces and mold shown in Example 1. Results of evaluation are shown in Table 6, from which it is evident that the present lubricants have distinguished formabilities, as compared with that of Comparative Example 1 shown in Example 1.

Figure 3:
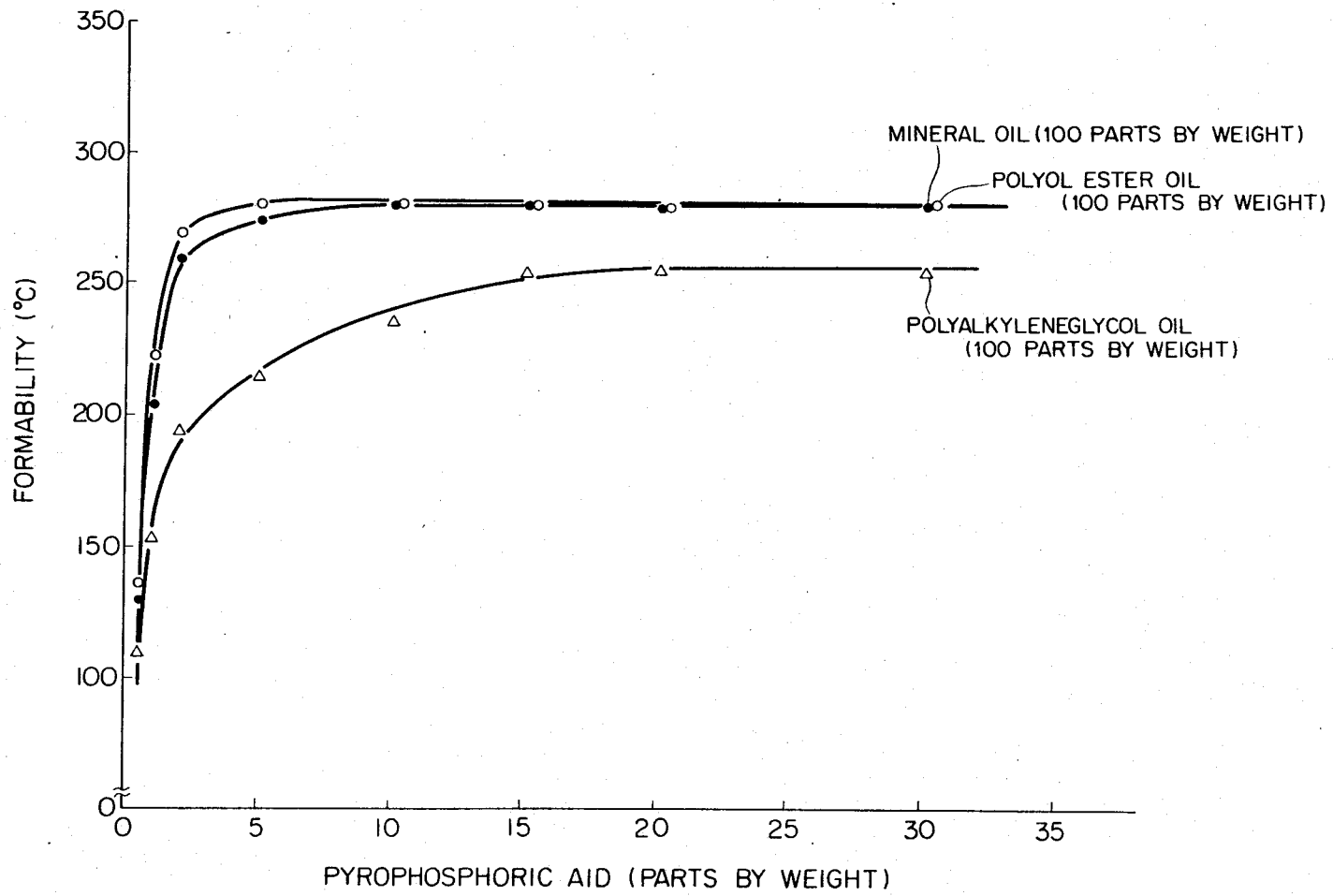
FIG. 3 is a diagram showing a relationship between the mixing ratio of the condensed phosphorus compound and the formability.

Formability of liquid lubricants obtained by adding pyrophosphoric acid as the condensed phosphorus compound in various mixing ratios to a predetermined amount of the mineral oil, polyol ester oil or polyalkyleneglycol oil used as the lubricating oil in Examples 1 to 28 are shown in FIG. 3.

EXAMPLES 29 TO 44

Formabilities of the present liquid lubricants having the compositions consisting of mineral oil, condensed phosphorus compound and fatty acid, as shown in Table 7 were evaluated in the same manner with the same workpieces and mold as in Example 1. Results of evaluation are shown in Table 7, from which it is evident that the present lubricants have distinguished formabilities, as compared with that of Comparative Example 1, shown in Example 1.

EXAMPLES 45 TO 61

Formabilities of the present liquid lubricants consisting of polyalkyleneglycol oil (viscosity at 40° C.: 82 $mm^2/s$), condensed phosphorus compound and fatty acid, as shown in Table 8, were evaluated in the same manner with the same workpieces and mold as in Example 1. Results of evaluation are shown in Table 8, from which it is evident that the present lubricants have an improved formability.

EXAMPLES 62 TO 77

Formabilities of the present lubricants consisting of mineral oil having a viscosity at 40° C. of 150 $mm^2/s$, polyphosphoric acid or sodium polyphosphate and octanoic acid, as shown in Table 9 were evaluated in the same manner with the same workpieces and mold as shown in Example 1. Results of evaluation are shown in Table 9, from which it is evident that the present lubricants have an improved formability.

Figure 4:
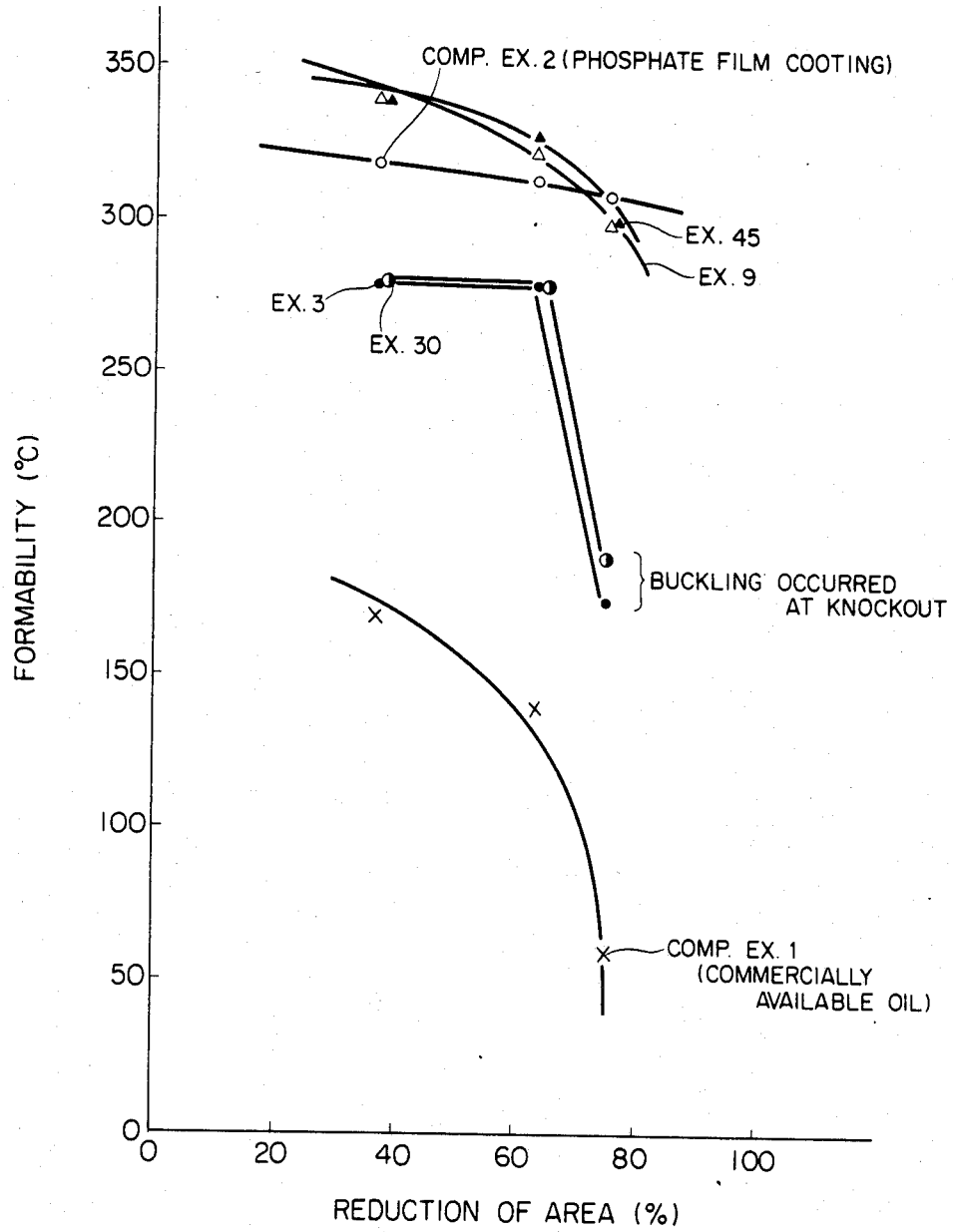
FIG. 4 is a diagram showing the reduction of area and the formability.

Relationship between the reduction of area and the formability obtained by testing typical examples of the present lubricants (i.e. Examples 3, 9, 30 and 40) and Comparative Examples 1 and 2 is shown in FIG. 4, from which it is evident that the present liquid lubricants have a formability equal or superior to that of the conventional phosphate coating requiring complicated coating steps up to the reduction of area of 64%.

EXAMPLES 77 TO 92

Formabilities of the present liquid lubricants having the compositions shown in Table 10 were evaluated in the same manner with the same workpieces as in Example 1, except that an ultra-hard mold with an extrusion angle of 120° and a draw diameter of 5 mm (reduction of area: 75%) was used. Formabilities of Comparative Examples 1 and 2 shown in Example 1 were also evaluated in the same manner as in Example 77. Results of evaluation are shown in Table 11, from which it is evident that the present lubricants of Examples 77–92 have a considerably improved formability.

Formabilities of workpieces 1, as shown in FIG. 1, subjected to lubricating film treatment by heating the workpieces 1 to 100° C. and dipping in the present lubricant of Example 77, 86 or 90 were evaluated in the same manner as in Example 77, and good formabilities similar to those shown in Table 11 were obtained.

EXAMPLES 93 TO 102

Formabilities of the present lubricants consisting of the same mineral oil as in Example 77 as the base oil, at least one of pyrophosphoric acid and sodium hydrogen pyrophosphate, and the organic compound having sulfur as an extreme pressure agent, as shown in Table 12 were evaluated in the same manner with the same workpieces and mold as in Example 77. Results of evaluation are shown also in Table 12, from which it is evident that the present lubricants have a good formability.

EXAMPLES 103 TO 108

Formabilities of the present liquid lubricants consisting of the same mineral oil as in Example 77 as the base oil, at least one of pyrophosphoric acid and sodium hydrogen pyrophosphate, and an organic compound containing chlorine, as shown in Table 13 were evaluated in the same manner with the same workpieces and mold as in Example 77. The results of evaluation are shown also in Table 13, from which it is evident that the present lubricants have a good formability.

EXAMPLES 109 TO 125

Formabilities of the present lubricants consisting of the same mineral oil as in Example 77 as the base oil, at least one of condensed phosphorus compounds, at least one of the organic compounds containing phosphorus, sulfur or chlorine, and at least one of the fatty acids were evaluated in the same manner with the same workpieces and mold as in Example 77. Results of evaluation are shown in Table 15, from which it is evident that the present lubricants have a good formability.

When 31 parts by weight of the organic compound containing chlorine was contained in the present lubricant, rusts were developed on the formed surface 1 to 2 days after the formed products were left standing indoors and in the air at room temperature, whereas, when 8 parts by weight of it was contained, tiny rust points were developed 5 to 7 days after the formed products were left standing under the same conditions as above.

EXAMPLES 126 TO 137

Formabilities of the present lubricants consisting of synthetic oil as the base oil, polyphosphoric acid and the organic compound containing phosphorus, sulfur, or chlorine as shown in Table 16 were evaluated in the same manner as in Example 77 to determine the effect of the species of the base oil on the species of the additives. Results of evaluation are shown also in Table 16, from which it is evident that the present lubricants have a good formability, irrespectively of the species of base oil.

TABLE 1

| Component (Parts by weight) | Example No. 1 | 2 | 3 | 4 | 5 | 6 | 7 | 8 | 9 | 10 |
|---|---|---|---|---|---|---|---|---|---|---|
| Mineral oil (viscosity at 40° C.: 500 $mm^2/s$) | 100 | 100 | 100 | 100 | 100 | 100 | 100 | 100 | 100 | 100 |
| Metaphosphoric acid | 10 | | | | | | | | | |
| Polyphosphoric acid | | 10 | | | | | | | 5 | |
| Pyrophosphoric acid | | | 10 | | | | | | | 5 |
| Sodium hydrogen polyphosphate | | | | 10 | | | | | | |
| Potassium hydrogen polyphosphate | | | | | 10 | | | | | |
| Sodium hydrogen pyrophosphate | | | | | | 10 | | | | |
| Potassium hydrogen pyrophosphate | | | | | | | 10 | | | |
| Sodium hydrogen metaphosphate | | | | | | | | 10 | | |

TABLE 2

| Reduction of area* (%) | Formability (°C.) Example No. 1 | 2 | 3 | 4 | 5 | 6 | 7 | 8 | 9 | 10 | Comp. Ex. 1 | 2 |
|---|---|---|---|---|---|---|---|---|---|---|---|---|
| 64 | 185 | >280 | >280 | 275 | 260 | 270 | 265 | 200 | 275 | 275 | 140 | >280 |

$$\text{*Reduction of area} = \frac{\text{Cross-sectional area before forming} - \text{Cross-sectional area after forming}}{\text{Cross-sectional area before forming}} \times 100$$

TABLE 3

| Components (Parts by weight) | Example No. 11 | 12 | 13 | 14 | 15 | 16 | 17 | 18 |
|---|---|---|---|---|---|---|---|---|
| Polyol ester oil (viscosity of 40° C.: 56 $mm^2/s$) | 100 | 100 | 100 | 100 | 100 | 100 | 100 | 100 |
| Metaphosphoric acid | 10 | | | | | | | |
| Polyphosphoric acid | | 10 | | | | | | |
| Pyrophosphoric acid | | | 10 | | | | | |
| Sodium hydrogen polyphsophate | | | | 10 | | | | |
| Potassium hydrogen polyphosphate | | | | | 10 | | | |
| Sodium hydrogen pyrophosphate | | | | | | 10 | | |
| Potassium hydrogen pyrophosphate | | | | | | | 10 | |
| Sodium | | | | | | | | 10 |

TABLE 3-continued

| Components (Parts by weight) | Example No. 11 | 12 | 13 | 14 | 15 | 16 | 17 | 18 |
|---|---|---|---|---|---|---|---|---|
| hydrogen metaphosphate | | | | | | | | |

TABLE 4

| Reduction of area (%) | Example No. Formability (°C.) 11 | 12 | 13 | 14 | 15 | 16 | 17 | 18 |
|---|---|---|---|---|---|---|---|---|
| 64 | 180 | 280 | 280 | 250 | 255 | 255 | 255 | 195 |

TABLE 5

| Components (parts by weight) | Example No. 19 | 20 | 21 | 22 | 23 | 24 | 25 | 26 | 27 | 28 |
|---|---|---|---|---|---|---|---|---|---|---|
| Polyalkyleneglycol (viscosity at 40° C.: 82 $mm^2/s$) | 100 | 100 | 100 | 100 | 100 | 100 | 100 | 100 | 100 | 100 |
| Metaphosphoric acid | 10 | | | | | | | | | |
| Polyphosphoric acid | | 10 | | | | | | | 2 | |
| Pyrophosphoric acid | | | 10 | | | | | | | 5 |
| Sodium hydrogen polyphosphate | | | | 10 | | | | | | |
| Potassium hydrogen polyphosphate | | | | | 10 | | | | | |
| Sodium hydrogen pyrophosphate | | | | | | 10 | | | | |
| Potassium hydrogen pyrophosphate | | | | | | | 10 | | | |
| Sodium hydrogen metaphosphate | | | | | | | | 10 | | |

TABLE 6

| Reduction of area (%) | Example No. Formability (°C.) 19 | 20 | 21 | 22 | 23 | 24 | 25 | 26 | 27 | 28 |
|---|---|---|---|---|---|---|---|---|---|---|
| 64 | 195 | 220 | 215 | 215 | 220 | 210 | 215 | 220 | 170 | 195 |

TABLE 7

| Components (parts by weight) | Example No. 29 | 30 | 31 | 32 | 33 | 34 | 35 | 36 | 37 | 38 | 39 | 40 | 41 | 42 | 43 | 44 |
|---|---|---|---|---|---|---|---|---|---|---|---|---|---|---|---|---|
| Mineral oil (viscosity of 40° C. 150 $mm^2/s$) | 100 | 100 | 100 | 100 | 100 | 100 | 100 | 100 | 100 | 100 | 100 | 100 | 100 | 100 | 100 | 100 |
| Pyrophosphoric acid | 12 | 12 | 12 | 12 | 12 | | | | | | | | | | | |
| Polyphosphoric acid | | | | | | 12 | 12 | 12 | 12 | 12 | | | | | | 12 |
| Sodium hydrogen polyphosphate | | | | | | | | | | | 12 | 12 | 12 | 12 | 12 | |
| Butanoic acid | 6 | | | | | 6 | | | | | 6 | | | | | |
| Octanoic acid | | 6 | | | | | 6 | | | | | 6 | | | | |
| Decanoic acid | | | 6 | | | | | 6 | | | | | 6 | | | |
| Dodecanoic acid | | | | 6 | | | | | 6 | | | | | 6 | | |
| Octadecanoic acid | | | | | 6 | | | | | 6 | | | | | 6 | |
| Dimer acid (3.8)* | | | | | | | | | | | | | | | | 6 |
| Forma- | 270 | >280 | >280 | >280 | 260 | 280 | >280 | >280 | >280 | 270 | 275 | >280 | >280 | >275 | >270 | 265 |

TABLE 7-continued

| Components (parts by weight) | Example No. 29 | 30 | 31 | 32 | 33 | 34 | 35 | 36 | 37 | 38 | 39 | 40 | 41 | 42 | 43 | 44 |
|---|---|---|---|---|---|---|---|---|---|---|---|---|---|---|---|---|
| bility (°C.) (Reduction of area: 64%) | | | | | | | | | | | | | | | | |

*( )Means a ratio of dimer/trimer.

TABLE 8

| Components (Parts by weight) | Example No. 45 | 46 | 47 | 48 | 49 | 50 | 51 | 52 | 53 | 54 | 55 | 56 | 57 | 58 | 59 | 60 | 61 |
|---|---|---|---|---|---|---|---|---|---|---|---|---|---|---|---|---|---|
| Polyalkyleneglycol oil (viscosity of 40° C.: 82 $mm^2/s$) | 100 | 100 | 100 | 100 | 100 | 100 | 100 | 100 | 100 | 100 | 100 | 100 | 100 | 100 | 100 | 100 | 100 |
| Metaphosphoric acid | 12 | 12 | 12 | 12 | 12 | | | | | | | | | | | | |
| Polyphosphoric acid | | | | | | 12 | 12 | 12 | 12 | 12 | | | | | | 2 | 12 |
| Sodium hydrogen polyphosphate | | | | | | | | | | | 12 | 12 | 12 | 12 | 12 | | |
| Butanoic acid | 6 | | | | | 6 | | | | | 6 | | | | | | |
| Octanoic acid | | 6 | | | | | 6 | | | | | 6 | | | | 1 | |
| Decanoic acid | | | 6 | | | | | 6 | | | | | 6 | | | | |
| Dodecanoic acid | | | | 6 | | | | | 6 | | | | | 6 | | | |
| Octadecanoic acid | | | | | 6 | | | | | 6 | | | | 6 | | | |
| Dimer acid (3.8)* | | | | | | | | | | | | | | | | | 6 |
| Formability (°C.) (Reduction of area: 64%) | 240 | 270 | 270 | 270 | 270 | 250 | 265 | 270 | 270 | 270 | 250 | 260 | 260 | 260 | 250 | 180 | 240 |

*( )Means a ratio of dimer/trimer.

TABLE 9

| Example No. | Lubricant composition (Parts by weight) Mineral oil | Polyphosphoric acid | Sodium polyphosphate | Otanoic acid | Formability* (°C.) |
|---|---|---|---|---|---|
| 62 | 100 | 5 | | | 240 |
| 63 | 100 | 25 | | | >280 |
| 64 | 100 | 43 | | | >280 |
| 65 | 100 | | 5 | | 260 |
| 66 | 100 | | 25 | | 270 |
| 67 | 100 | | 43 | | 280 |
| 68 | 100 | 5 | | 1 | 250 |
| 69 | 100 | | 5 | 1 | 275 |
| 70 | 100 | 5 | | 2 | 255 |

TABLE 9-continued

| Example No. | Lubricant composition (Parts by weight) Mineral oil | Polyphosphoric acid | Sodium polyphosphate | Otanoic acid | Formability* (°C.) |
|---|---|---|---|---|---|
| 71 | 100 | | 5 | 2 | 275 |
| 72 | 100 | 19 | | 9 | >280 |
| 73 | 100 | | 19 | 9 | >280 |
| 74 | 100 | 33 | | 33 | >280 |
| 75 | 100 | | 33 | 33 | >280 |
| 76 | 100 | 75 | | 75 | >280 |
| 77 | 100 | | 75 | 75 | >280 |

*Reduction of area: 64%

TABLE 10

| Components (Parts by weight) | Example No. 77 | 78 | 79 | 80 | 81 | 82 | 83 | 84 | 85 | 86 | 87 | 88 | 89 | 90 | 91 | 92 |
|---|---|---|---|---|---|---|---|---|---|---|---|---|---|---|---|---|
| Mineral oil (viscosity at 40° C.: 150 $mm^2/s$) | 100 | 100 | 100 | 100 | 100 | 100 | 100 | 100 | 100 | 100 | 100 | 100 | 100 | 100 | 100 | 100 |
| Pyrophosphoric acid | 5 | 4 | 5 | 5 | 3 | 3 | 3 | 3 | 3 | 4 | 4 | 4 | 2 | 2 | 3 | 2 |
| Sodium hydrogen pyrophosphate | | 1 | | | | | | | | 1 | | | 2 | 2 | 1 | |
| Triphenyl phosphite | | | 18 | | | | | | | | | | 6 | 6 | | |
| Diphenyl phosphite | | 18 | | | | | | | | | | | | | 6 | |
| Trioleyl phosphite | | | | 18 | | | | | | | | | 6 | 6 | | |
| Dioleyl phosphite | 18 | | | | | | | | | | | | | | | 6 |
| Monobutyl phosphate | | | | | 11 | | | | | | | | | | 6 | |
| Dibutyl phosphate | | | | | | 11 | | | | 18 | | | | | | |
| Methyl hydrogen phosphate | | | | | | | 11 | | | | | | | | | |
| Octyl hydrogen phosphate | | | | | | | | | | | | | | | | |
| Oleyl hydrogen phosphate | | | | | | | | | | | | | | | | |
| Tris-dichloro- | | | | | | | | | | | 18 | | 6 | | | |

TABLE 10-continued

| Components (Parts by weight) | Example No. 77 | 78 | 79 | 80 | 81 | 82 | 83 | 84 | 85 | 86 | 87 | 88 | 89 | 90 | 91 | 92 |
|---|---|---|---|---|---|---|---|---|---|---|---|---|---|---|---|---|
| propyl phosphate | | | | | | | | | | | | | | | | |
| Trilaurylthio-phosphate | | | | | | | | | | | | 18 | | 6 | | 12 |

TABLE 11

| Examples No. | Formability (°C.) |
|---|---|
| 77 | 245 |
| 78 | 260 |
| 79 | 280 |
| 80 | 270 |
| 81 | 340 |
| 82 | 270 |
| 83 | 260 |
| 84 | 280 |
| 85 | 300 |
| 86 | 280 |
| 87 | 245 |
| 88 | 240 |
| 89 | 295 |
| 90 | 280 |
| 91 | 315 |
| 92 | 285 |
| Comparative Example | |
| 1 | 60 |

TABLE 11-continued

| | Formability (°C.) |
|---|---|
| 2 | 300–320 |

TABLE 12

| Components (Parts by weight) | Example No. 93 | 94 | 95 | 96 | 97 | 98 | 99 | 100 | 101 | 102 |
|---|---|---|---|---|---|---|---|---|---|---|
| Mineral oil (viscosity at 40° C.: 150 $mm^2/s$) | 100 | 100 | 100 | 100 | 100 | 100 | 100 | 100 | 100 | 100 |
| Pyrophosphoric acid | 3 | 3 | 3 | 3 | 3 | 3 | 2 | 7 | 5 | |
| Sodium hydrogen pyrophosphate | | | | | | | 1 | | 1 | 4 |
| Sulfurized oil | 11 | | | | | | 6 | | | 6 |
| Dibenzyl disulfide | | 11 | | | | | | | | |
| Sulfurized olefin | | | 11 | | | | | 20 | 20 | |
| di-t-nonyl polysulfide | | | | 11 | | | | | | |
| di-n-octyl disulfide | | | | | 11 | | | | | 12 |
| Polyoxyethylene polysulfide | | | | | | 11 | 6 | 7 | 7 | |
| Formability (°C.) | 230 | 245 | 240 | 220 | 250 | 265 | 270 | 260 | 250 | 235 |

TABLE 13

| Components (Parts by weight) | Example No. 103 | 104 | 105 | 106 | 107 | 108 |
|---|---|---|---|---|---|---|
| Mineral oil (viscosity at 40° C.: 150 $mm^2/s$) | 100 | 100 | 100 | 100 | 100 | 100 |
| Pyrophosphoric acid | 3 | 3 | 3 | 2 | 2 | |
| Sodium hydrogen pyrophosphate | | | | 1 | 1 | 2 |
| Chlorinated paraffin | 11 | | | 11 | | 11 |
| Pentachlorofatty acid ester | | 11 | | | 6 | |
| Chlorinated fatty acid ester | | | 11 | | 6 | |
| Formability (°C.) | 250 | 230 | 225 | 250 | 260 | 225 |

TABLE 14

| Components (Parts by weight) | Example No. 109 | 110 | 111 | 112 | 113 | 114 | 115 | 116 | 117 | 118 | 119 | 120 | 121 | 122 | 123 | 124 | 125 |
|---|---|---|---|---|---|---|---|---|---|---|---|---|---|---|---|---|---|
| Mineral oil (viscosity at 40° C.: 150 $mm^2/s$) | 100 | 100 | 100 | 100 | 100 | 100 | 100 | 100 | 100 | 100 | 100 | 100 | 100 | 100 | 100 | 100 | 100 |
| Polyphosphoric acid | 8 | 8 | 8 | | | | 2 | | 14 | | | 3 | 3 | 3 | | | |
| Pyrophosphoric acid | | | | 8 | | | | 1 | | 2 | 13 | | | | | | |
| Sodium hydrogen polyphosphate | | | | | 8 | | 5 | | 1 | | | | | | 3 | 3 | 3 |
| Potassium hydrogen polyphosphate | | | | | | 8 | | 4 | | | | | | | | | |
| Dioleyl hydrogen phosphite | 31 | | | | | 31 | 8 | 12 | 3 | | | 6 | | | 6 | | |
| Isobutene sulfide | | 31 | | 31 | | | 8 | | 7 | 6 | | | 6 | | | 6 | |
| Chlorinated oil | | | 31 | | 31 | | 8 | | | 1 | 1 | | | 6 | | | 6 |
| Butanoic acid | 15 | | | | | | | | | | | | | | | | |
| Heptanoic acid | | 15 | | | | | 16 | | | | | | | | | | |
| Decanoic acid | | | 15 | | | | | | 14 | | | | | | | | |
| Octadecanoic acid | | | | 15 | | | | | | | 13 | | | | | | |
| 2,4-Hexadienoic | | | | | | | 16 | | | | | | | | | | |

TABLE 14-continued

| Components (Parts by weight) | Example No. 109 | 110 | 111 | 112 | 113 | 114 | 115 | 116 | 117 | 118 | 119 | 120 | 121 | 122 | 123 | 124 | 125 |
|---|---|---|---|---|---|---|---|---|---|---|---|---|---|---|---|---|---|
| acid | | | | | | | | | | | | | | | | | |
| cis-9-cis-12-octadienoic acid | | | | | | 15 | | | | | | 19 | 19 | 19 | 19 | 19 | 19 |
| Oleic acid | | | | | 15 | | | | | 12 | | | | | | | |
| Dimer acid (Bersadim 216*) | | | | | | | | 6 | | | | | | | | | |

*Trademark

TABLE 15

| Example No. | Formability (°C.) | Remarks |
|---|---|---|
| 109 | 250 | |
| 110 | 255 | |
| 111 | 250 | Rusts developed on the surfaces of workpieces 1 to 2 days after the forming. |
| 112 | 245 | |
| 113 | 240 | Rusts developed on the surfaces of workpieces 1 to 2 days after the forming. |
| 114 | 255 | |
| 115 | 260 | Tiny rust spots developed 5 to 7 days after the forming. |
| 116 | 230 | |
| 117 | 220 | Backling occurred at the knockout, but no galling appeared. |
| 118 | 265 | |
| 119 | 215 | Buckling occurred at the knockout but no galling appeared. |
| 120 | 295 | |
| 121 | 300 | |
| 122 | 285 | Tiny rust spots developed 5 to 7 days after the forming. |
| 123 | 240 | |
| 124 | 225 | |
| 125 | 230 | Tiny rust spots developed 5 to 7 days after the forming. |

Buckling means bending at the part made narrower by drawing in the mold shown in FIG. 2.

Knockout means withdrawal of formed workpiece from the mold shown in FIG. 2.

TABLE 16

| Example No. | Additives (parts by weight): Poly-phosphoric acid | Dioleyl hydrogen phosphite | Isobutyl sulfide | chlorinated paraffin | Luricating oil (parts by weight): Polyol ester oil (56 mm²/s) | Polyphonyl ether oil (300 mm²/s) | Floro-silicone oil (200 mm²/s) | Formability (°C.) |
|---|---|---|---|---|---|---|---|---|
| 126 | 2 | 12 | | | 100 | | | 290 |
| 127 | 2 | 12 | | | | 100 | | 330 |
| 128 | 2 | 12 | | | | | 100 | 300 |
| 129 | 2 | | 12 | | 100 | | | 250 |
| 130 | 2 | | 12 | | | 100 | | 235 |
| 131 | 2 | | 12 | | | | 100 | 245 |
| 132 | 2 | | | 12 | 100 | | | 225 |
| 133 | 2 | | | 12 | | 100 | | 230 |
| 134 | 2 | | | 12 | | | 100 | 230 |
| 135 | 2 | 6 | 6 | | 100 | | | 300 |
| 136 | 2 | | 6 | 6 | | 100 | | 250 |
| 137 | 2 | 6 | | 6 | | | 100 | 275 |

( ) Means a viscosity at 40° C.

As described above, the present substantially water-free, liquid lubricant for metal forming, which comprises a lubricating oil, at least one of the condensed phosphorus compounds and at least one of the organic compounds containing phosphorus, sulfur or chlorine as an extreme pressure agent, and which furthermore contains a fatty acid, can form a lubricating film with a good heat resistance and a good lubricating ability by heat generated during the metal forming only by wetting the surface of a workpieces or a mold with it and can work effectively for preventing the workpiece from galling, greatly contributing to simplification of the production steps and reduction in product cost.

What is claimed is:

1. A substantially water-free, liquid lubricant for metal forming, which comprises a lubricating oil and at least one condensed phosphorus compound selected from the group consisting of linearly condensed phosphorus compounds represented by the following general formula (1):

$$M_mH_{n+2-m}P_nO_{3n+1} \quad (1)$$

wherein m is an integer of 0, 1, . . . , n+1, n is an integer of 2 to 6, and M is an alkali metal, and cyclically condensed phosphorus compounds represented by the following general formulae (2) and (3):

$$(HPO_3)_n \quad (2)$$

$$M_xH_y(PO_3)_{x+y} \quad (3)$$

wherein n is an integer of 2 to 8, M is an alkali metal, and each of x and y is an integer of 1 or more, where $x+y \leqq 8$ and wherein 2 to 20 parts by weight of the condensed phosphorus compound is present per 100 parts by weight of the lubricating oil.

2. A substantially water-free, liquid lubricant according to claim 1, wherein the lubricating oil is a mineral oil or a synthetic oil.

3. A substantially water-free, liquid lubricant according to claim 1, wherein the condensed phosphorus compound is metaphosphoric acid, polyphosphoric acid, pyrophosphoric acid, acid salt of metaphosphoric acid, acid salt of polyphosphoric acid or acid salt of pyrophosphoric acid.

4. A substantially water-free, liquid lubricant according to claim 1, wherein said lubricant further contains 1 to 33 parts by weight of a fatty acid per 100 parts by weight of the lubricating oil.

5. A substantially water-free, liquid lubricant for metal forming, which comprises a lubricating oil, at least one condensed phosphorus compound selected from the group consisting of linearly condensed phosphorus compounds represented by the following general formula (1):

$$M_mH_{n+2-m}P_nO_{3n+1} \quad (1)$$

wherein m is an integer of 0, 1, . . . , n+1, n is an integer of 2 to 6, and M is an alkali metal, and cyclically condensed phosphorus compounds represented by the following general formulae (2) and (3):

$$(HPO_3)_n \quad (2)$$

$$M_xH_y(PO_3)_{x+y} \quad (3)$$

wherein n is an integer of 2 to 8, M is an alkali metal, and each of x and y is an integer of 1 or more, where $x+y \leqq 8$, and at least one of organic compounds containing phosphorus, sulfur or chlorine as an extreme pressure agent, and wherein 1 to 10 parts by weight of the condensed phosphorus compound and 5 to 30 parts by weight of the organic compound as the extreme-pressure agent are present per 100 parts by weight of the lubricating oil.

6. A substantially water-free, liquid lubricant according to claim 5, wherein the lubricating oil is a mineral oil or a synthetic oil.

7. A substantially water-free, liquid lubricant according to claim 5, wherein the condensed phosphorus compound is metaphosphoric acid, polyphosphoric acid, pyrophosphoric acid, acid salt of metaphosphoric acid, acid salt of polyphosphoric acid or acid salt of pyrophosphoric acid.

8. A substantially water-free, liquid lubricant according to claim 5, wherein the organic compounds as the extreme-pressure agent are triphenyl phosphite, tricresyl phosphite, diphenylnonylphenyl phosphite, tris-(nonylphenyl)phosphite, triisooctyl phosphite, diphenylisodecyl phosphite, phenyldiisodecyl phosphite, triisodecyl phosphite, trilauryl phosphite, trioctadecyl phosphite, trioleyl phosphite, trilauryl trithiophosphite, diisodecyl hydrogen phosphite, dilauryl hydrogen phosphite, dioleyl hydrogen phosphite, tris-chloroethyl phosphite, tris-tridecyl phosphite, dibutyl hydrogen phosphite, trimethyl phosphate, triethyl phosphate, tributyl phosphate, tributoxyethyl phosphate, triphenyl phosphate, tricresyl phosphate, trixylenyl phosphate, cresyldiphenyl phosphate, octyldiphenyl phosphate, xylenyldiphenyl phosphate, trilauryl phosphate, tricetyl phosphate, tristearyl phosphate, trioleyl phosphate, dibutyl phosphate, monobutyl phosphate, dioctyl phosphate, monoisodecyl phosphate, tris-chloroethyl phosphate, tridichloropropyl phosphate, methyl hydrogen phosphate, isopropyl hydrogen phosphate, butyl hydrogen phosphate, octyl hydrogen phosphate, isodecyl hydrogen phosphate, lauryl hydrogen phosphate, tridecanol hydrogen phosphate, octadecyl hydrogen phosphate, oleyl hydrogen phosphate, sulfurized oil, sulfurized dipentene, sulfurized isobutene, sulfurized olefin, dibenzyl disulfide, polysulfide, xanthic disulfide, di-t-butyl sulfide, diphenyl disulfide, di-n-butyl sulfide, di-t-nonyl polysulfide, di-n-octyl disulfide, polyoxyethylene polysulfide, chlorinated paraffin, chlorinated oil, chlorinated fatty acid ester, and pentachlorofatty acid ester.

9. A substantially water-free, liquid lubricant according to claim 5, wherein said lubricant further contains a fatty acid and wherein 1 to 10 parts by weight of the condensed phosphorus compound, 1 to 30 parts by weight of the organic acid as the extreme-pressure agent, and 6 to 20 parts by weight of the fatty acid are present per 100 parts by weight of the lubricating oil.

10. A substantially water-free, liquid lubricant according to claim 1 or claim 5, wherein said lubricant further contains 0.1 to 5 parts by weight of an emulsifying agent per 100 parts by weight of the lubricating oil.

11. A substantially water-free, liquid lubricant for metal forming, which comprises 100 parts by weight of mineral oil having a viscosity of 50 to 200 $mm^2/s$ at 40° C., 3 to 8 parts by weight of linear polyphosphoric acid, 9 to 24 parts by weight of an acid phosphate ester, and 0.5 to 2 parts by weight of an emulsifying agent.

12. A substantially water-free, liquid lubricant according to claim 11, wherein the acid phosphite ester is dioleyl hydrogen phosphite and the emulsifying agent is polymeric succinic acid ester.

13. A process for metal forming, which comprises applying a lubricant for metal forming to the surface of a metallic workpiece or the surface of a mold counterposed to the workpiece, and depositing a lubricating film on the surface of the workpiece by heat generated during plastic forming, the lubricant being a substantially water-free, liquid lubricant for metal forming, which comprises a lubricating oil and at least one condensed phosphorus compound selected from the group consisting of linearly condensed phosphorus compounds represented by the following general formula (1):

$$M_mH_{n+2-m}P_nO_{3n+1} \quad (1)$$

wherein m is an integer of 0, 1, . . . n+1, n is an integer of 2 to 6, and M is an alkali metal, and cyclically condensed phosphorus compounds represented by the following general formulae (2) and (3):

$$(HPO_3)_n \quad (2)$$

$$M_xH_y(PO_3)_{x+y} \quad (3)$$

wherein n is an integer of 2 to 8, M is an alkali metal, and each of x and y is an integer of 1 or more, where $x+y \leqq 8$, and wherein 2 to 20 parts by weight of the condensed phosphorus compound is present per 100 parts by weight of the lubricating oil.

14. A process according to claim 13, wherein said lubricant further contains 1 to 33 parts by weight of a fatty acid per 100 parts by weight of the lubricating oil.

15. A process for metal forming, which comprises applying a lubricant for metal forming to the surface of a metallic workpiece or the surface of a mold counterposed to the workpiece, and depositing a lubricating film on the surface of the workpiece by heat generated during plastic forming, the lubricant being a substantially water-free, liquid lubricant for metal forming, which comprises a lubricating oil, at least one condensed phosphorus compound selected from the group consisting of linearly condensed phosphorus compounds represented by the following general formula (1):

$$M_mH_{n+2-m}P_nO_{3n+1} \quad (1)$$

wherein m is an integer of 0, 1, . . . , n+1, n is an integer of 2 to 6, and M is an alkali metal, and cyclically condensed phosphorus compounds represented by the following general formulae (2) and (3):

$$(HPO_3)_n \quad (2)$$

$$M_xH_y(PO_3)_{x+y} \quad (3)$$

wherein n is an integer of 2 to 8, M is an alkali metal, and each of x and y is an integer of 1 or more, where $x+y \leqq 8$, and at least one of organic compounds containing phosphorus, sulfur or chlorine as an extreme pressure agent, and wherein 1 to 10 parts by weight of the condensed phosphorus compound and 5 to 30 parts by weight of the organic compound as the extreme-pressure agent are present per 100 parts by weight of the lubricating oil.

16. A process according to claim 15, wherein said lubricant further contains a fatty acid and wherein 1 to 10 parts by weight of the condensed phosphorus compound, 1 to 30 parts by weight of the organic acid as the extreme-pressure agent, and 6 to 20 parts by weight of the fatty acid are present per 100 parts by weight of the lubricating oil.

17. A process according to claim 13 or 15, wherein said lubricant further contains 0.1 to 5 parts by weight of an emulsifying agent per 100 parts by weight of the lubricating oil.

18. A process for metal forming, which comprises applying a lubricant for metal forming to the surface of a metallic workpiece or the surface of a mold counterposed to the workpiece, and depositing a lubricating film on the surface of the workpiece by heat generated during metal forming, the lubricant being a substantially water-free, liquid lubricant for metal forming, which comprises 100 parts by weight of mineral oil having a viscosity of 50 to 200 $mm^2/s$ at 40° C., 3 to 8 parts by weight of linear polyphosphoric acid, 9 to 24 parts by weight of an acid phosphite ester, and 0.5 to 2 parts by weight of an emulsifying agent.

* * * * *